US005701639A

United States Patent [19]

Chen

[11] Patent Number: 5,701,639

[45] Date of Patent: Dec. 30, 1997

[54] SECURING DEVICE FOR FOOTWEAR

[76] Inventor: He-Jin Chen, No.17, Alley 33, Lane 24, Sec 3, Chung Yang Road, Lung-Ching Hsiang, Taichung Shien, Taiwan

[21] Appl. No.: 789,383

[22] Filed: Jan. 28, 1997

[51] Int. Cl.[6] ..... A43C 11/00

[52] U.S. Cl. ..... 24/71 SK; 36/50.1; 24/68 SK; 24/69 SK; 24/70 SK; 24/629

[58] Field of Search ..... 24/68 SK, 69 R, 24/69 SK, 69 CT, 70 SK, 71 SK, 311, 573, 629; 36/50.1, 51

[56] References Cited

U.S. PATENT DOCUMENTS

| | | | |
|---|---|---|---|
| 4,604,772 | 8/1986 | Arff | 24/311 X |
| 4,761,898 | 8/1988 | Courvoisier et al. | 36/50.1 X |
| 4,826,098 | 5/1989 | Pozzobon et al. | 24/68 SK X |
| 4,852,222 | 8/1989 | Courvoisier et al. | 24/71 SK X |
| 5,172,454 | 12/1992 | Martignago | 24/68 SK |
| 5,226,246 | 7/1993 | Soo | 36/50.1 |
| 5,357,690 | 10/1994 | Ho | 36/50.1 |
| 5,561,891 | 10/1996 | Hsieh | 24/633 X |
| 5,575,045 | 11/1996 | Chu | 36/50.1 X |

*Primary Examiner*—Peter M. Cuomo
*Assistant Examiner*—Robert J. Sandy
*Attorney, Agent, or Firm*—Bacon & Thomas

[57] ABSTRACT

A securing device for footwear includes a receiving member pivotally connected to a base which is fixedly connected to the footwear and a stop extending upwardly therefrom, a toothed band having one end pivotally connected to the receiving member and the other end of the toothed band fixedly connected to a fixing member on the footwear, and an operating member which is pivotally and slidably received in a receiving space defined in the receiving member. The receiving space accesses a lateral side of the receiving member and is defined by a top, an end wall and a bottom in which a slot is defined. The operating member has a limit member extending therefrom and extending through the slot, a hole defined through the operating member so the stop movably received in the hole. An inner periphery defining the hole has a hook member extending therefrom so as to engage with the stop when tightening the toothed band and disengaged with the stop when pushing the operating member in the receiving space.

1 Claim, 4 Drawing Sheets

SECURING DEVICE FOR FOOTWEAR

BACKGROUND OF THE INVENTION

1. Field of the Invention

The present invention relates to a securing device and, more particularly, to an improved securing device for footwear and the securing device is operated on lateral side thereof.

2. Brief Description of the Prior Art

A securing device for footwear is disclosed in an invention entitled as "SECURING DEVICE, PARTICULARLY FOR FOOTWEAR" which is patented on Dec. 22, 1992, U.S. Pat. No. 5,172,454 to Martignago. However, it is experienced that an accidental impact of the receiving member of a securing device such as the U.S. Pat. No. 5,172,454 will leads an opening of the securing device. This could cause a dangerous result.

The present invention intends to provide an improved securing device for footwear to mitigate and/or obviate the above-mentioned problems.

SUMMARY OF THE INVENTION

The present invention provides a securing device for footwear and comprises a base fixedly disposed to the footwear and having one end with two lugs extending therefrom, the other end of the base having a stop extending upwardly therefrom.

A receiving member has a first end with two arms extending therefrom so as to pivotally connected to the two lugs of the base and one end of a toothed band, a second end of the receiving member having a receiving space defined therein which accesses to a lateral side of the receiving member. The receiving space defined by a top, a bottom and an end wall wherein the bottom has a slot and a first hole respectively defined therethrough. The end wall has a recessed portion defined therein for receiving a spring therein.

An operating member has one end with a shaft extending downwardly from an under side thereof so as to be rotatably received in the first hole and the other end of the operating member has a rod extending transversely therefrom so as to be inserted in the spring. A limit member extends from the under side of the operating member and is movably received in the slot. The operating member has a second hole defined therethrough by an inner periphery defining the second hole, the inner periphery defining the second hole having a hook member extending laterally therefrom so that the stop is inserted in the second hole and the hook member is detachably engaged with the stop.

It is an object of the present invention to provide a securing device for footwear and an operating member of the device extends toward a lateral side of the receiving member so as to effectively avoid from an unintentionally impact of the operating member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
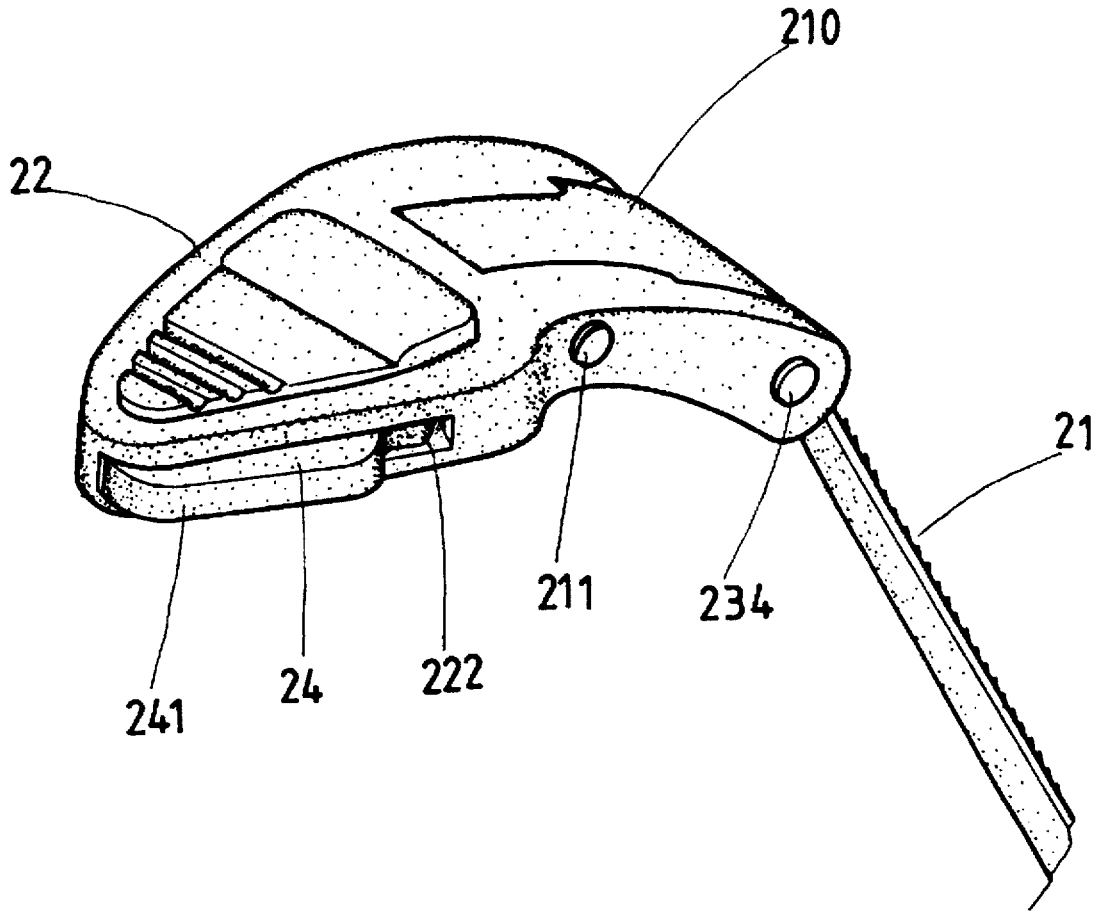
FIG. 1 is a perspective view of a securing device in accordance with the present invention.
Figure 2:
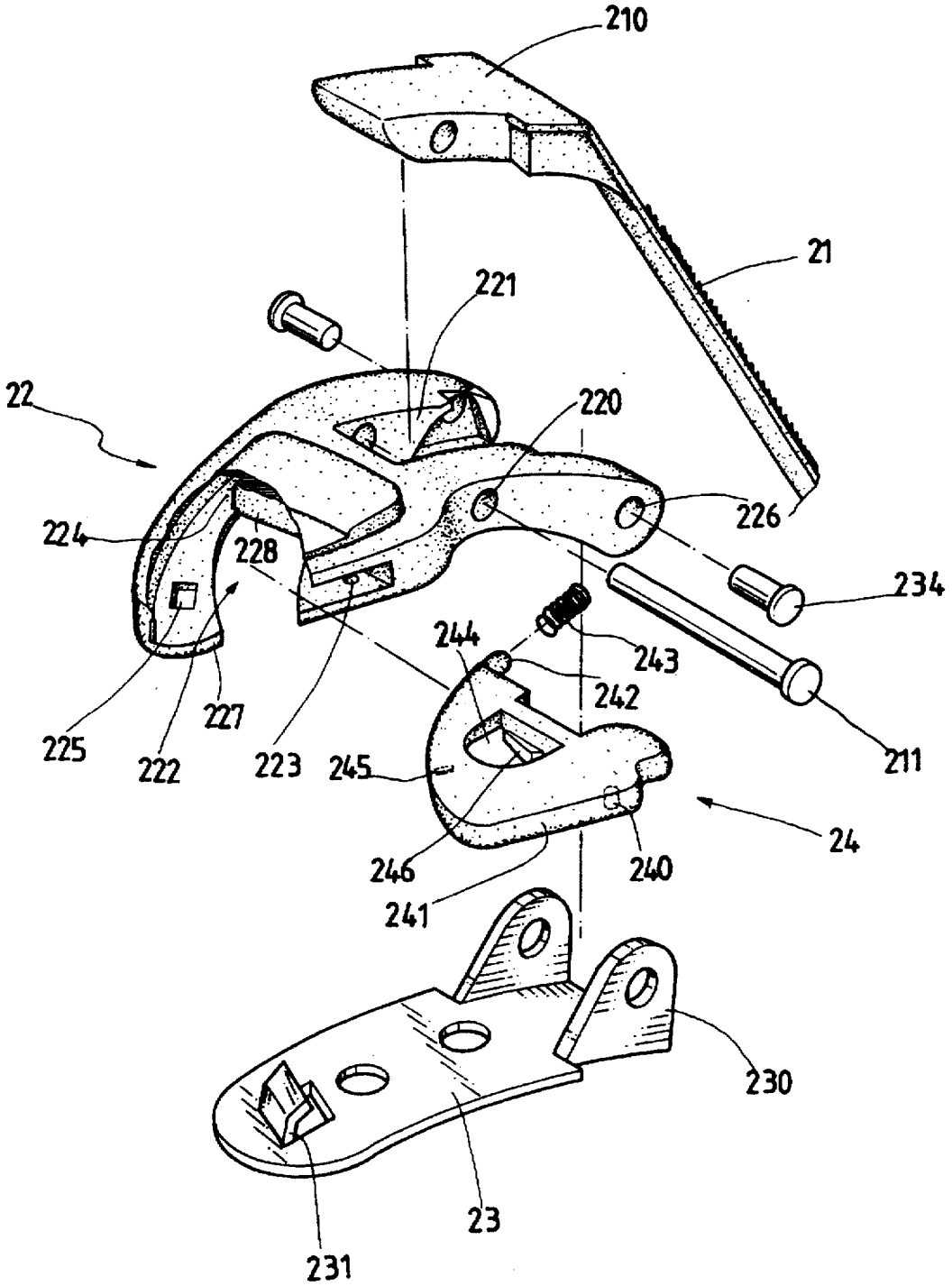
FIG. 2 is an exploded view of the securing device in accordance with the present invention.
Figure 3:
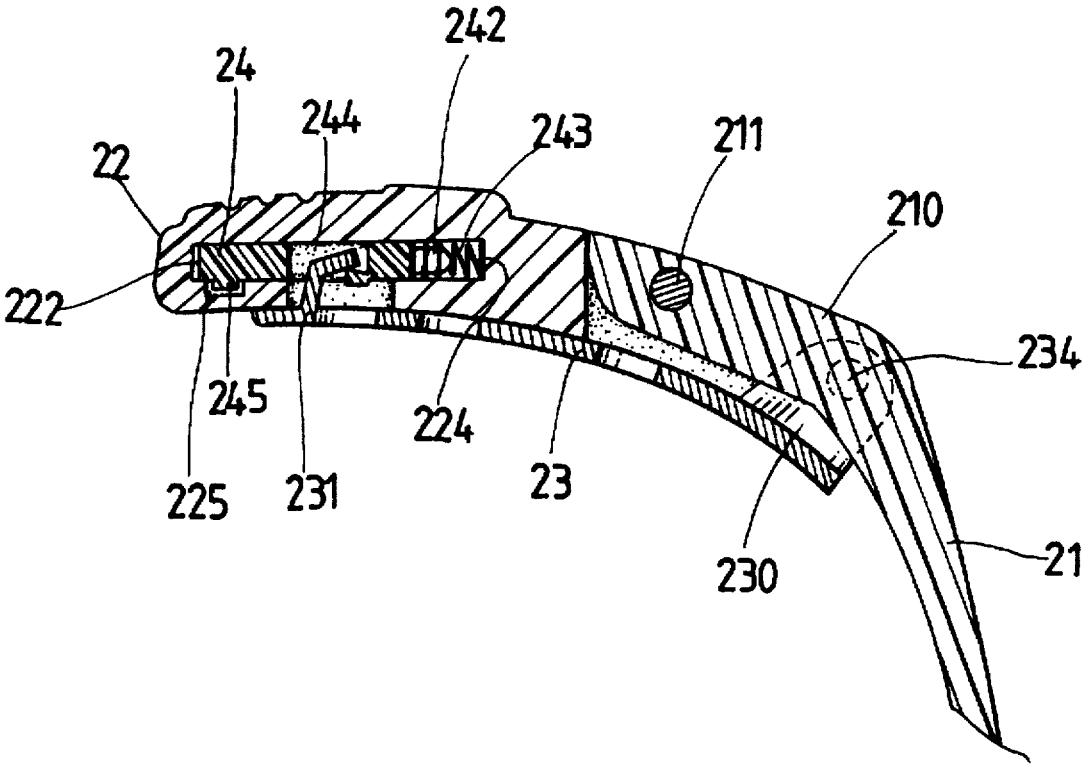
FIG. 3 is a side elevational view, partly in section, of the securing device of the present invention.

Referring to the drawings and initially to FIGS. 1 through 3, a securing device for footwear in accordance with the present invention generally includes a base 23 fixedly disposed to one side of the footwear (not shown), a receiving member 22, an operating member 24 received in the receiving member 22 and a toothed band 21 which has one end being a head 210 pivotally connected to the receiving member 22 and the other end of the toothed band 21 fixedly connected to a fixing member (not shown) which is fixedly disposed to the other side of the footwear. The base 23 has one end with two lugs 230 extending therefrom and the other end of the base 23 has a stop 231 extending upwardly therefrom.

The receiving member 22 has a first end with two arms 221 extending therefrom and a second end of the receiving member 22 has a receiving space 222 defined therein wherein the receiving space 222 accesses to a lateral side of the receiving member 22. Each of the arms 221 has a first engaging hole 226 and a second engaging hole 220 respectively defined therethrough so that the two lugs 230 are pivotally connected to the two first engaging holes 226 by two short pins 234 and the head 210 is pivotally connected between the two arms 221 by a long pin 211. The receiving space 222 is defined by a top, a bottom 227 and an end wall 228 wherein the bottom 227 has a slot 225 and a first hole 223 respectively defined therethrough, the end wall 228 having a recessed portion 224 defined therein for receiving a spring 243 therein.

The operating member 24 has one end with a shaft 240 extending downwardly from an under side thereof so as to be rotatably received in the first hole 223 and the other end of the operating member 24 has a rod 242 extending transversely therefrom so as to be inserted in the spring 243 such that the operating member 24 has one side 241 thereof extending from the receiving space 222 and is exposed to users (not shown). A limit member 245 extends from the under side of the operating member 24 so as to be movably received in the slot 225 of the bottom 227 and a second hole 244 is defined through the operating member 24 by an inner periphery defining the second hole 244. The inner periphery defining the second hole 244 has a hook member 246 extending laterally therefrom so that the stop 231 extends through the second hole 244 when the operating member 24 is pivotally received in the receiving space 222. When the toothed band 21 is tightened, the hook member 246 is engaged with the stop 231 so that the receiving member 22 and the head 210 of the toothed band 21 are unable to be pulled upwardly as shown in FIG. 3.

Figure 4:
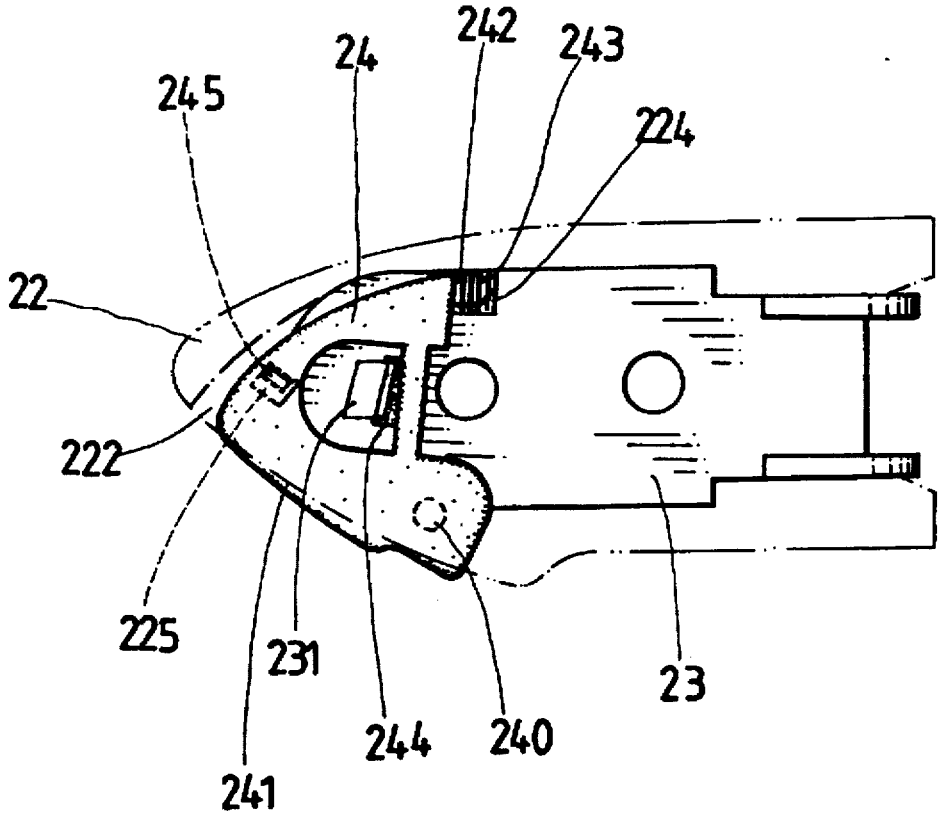
FIG. 4 is an illustrative view to show when the operating member is pushed, the hook member is disengaged from the stop.

Referring to FIG. 4, when the user wants to loosen the securing device, he/she must push the side 241 of the operating member 24 to press the spring 243 so that the operating member 24 pivoted about an axis of the shaft 240 and the hook member 246 is shifted to disengaged from the stop 231 such that the receiving member 22 and the head 210 can be pulled upwardly to loosen the toothed band 21.

Accordingly, the side 241 of the operating member 24 is located a lateral side of the receiving member 22 so that users can use their thumb to push the operating member 22 easily and the device assures that an opening of the securing device by an unintentional impact is effectively avoided.

Although the invention has been explained in relation to its preferred embodiment, it is to be understood that many other possible modifications and variations can be made without departing from the spirit and scope of the invention as hereinafter claimed.

What is claimed is:

1. A securing device for footwear, comprising:

a base (23) fixedly disposed to one side of said footwear and having one end with two lugs (230) extending therefrom, the other end of said base (23) having a stop (231) extending upwardly therefrom;

a receiving member (22) having a first end with two arms (221) extending therefrom so as to pivotally connected to said two lugs (230) of said base (23) and a second end of said receiving member (22) having a receiving space (222) defined therein wherein said receiving space (222) accesses to a lateral side of said receiving member (22), said receiving space (222) defined by a top, a bottom (227) and an end wall (228) wherein said bottom (227) has a slot (225) and a first hole (223) respectively defined therethrough, said end wall (228) having a recessed portion (224) defined therein for receiving a spring (243) therein;

an operating member (24) having one end with a shaft (240) extending downwardly from an under side thereof so as to be rotatably received in said first hole (223) and the other end of said operating member (24) having a rod (242) extending transversely therefrom so as to be inserted in said spring (243), a limit member (245) extending from said under side of said operating member (24) so as to be movably received in said slot (225) of said bottom (227), said operating member (24) having a second hole (244) defined therethrough by an inner periphery defining said second hole (244), said inner periphery defining said second hole (244) having a hook member (246) extending laterally therefrom so that said stop (231) is inserted in said second hole (244) and said hook member (246) is detachably engaged with said stop (231), and a toothed band (21) having a head (210) formed on one end thereof and said head (210) pivotally engaged between said two arms (221).

* * * * *